US007548215B2

(12) United States Patent
Huang et al.

(10) Patent No.: US 7,548,215 B2
(45) Date of Patent: Jun. 16, 2009

(54) MULTI-BEAM-REFLECTOR DISH ANTENNA SYSTEM AND METHOD FOR PRODUCTION THEREOF

(75) Inventors: Chang-Hsiu Huang, Taipei Hsien (TW); Chung-Min Lai, Taipei Hsien (TW); An-Hung Huang, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 140 days.

(21) Appl. No.: 11/775,217

(22) Filed: Jul. 9, 2007

(65) Prior Publication Data

US 2009/0015503 A1 Jan. 15, 2009

(51) Int. Cl.
*H01Q 19/12* (2006.01)
*H01Q 13/00* (2006.01)

(52) U.S. Cl. ..... 343/840; 343/779

(58) Field of Classification Search ..... 343/840, 343/779, 912, 914

See application file for complete search history.

(56) References Cited

U.S. PATENT DOCUMENTS 6,731,249 B1 * 5/2004 Gau et al. ..... 343/840
7,030,832 B2 * 4/2006 Gau et al. ..... 343/840

* cited by examiner

*Primary Examiner*—Hoang V Nguyen
(74) *Attorney, Agent, or Firm*—Winston Hsu

(57) ABSTRACT

A multi-beam-reflector dish antenna system and a method for production thereof are disclosed. Signals from different satellites are simultaneously received using a single compound LNBF module. The multi-beam-reflector dish antenna system includes a reflector with N-th order projected aperture and a single compound LNBF module constituting multiple LNBF units. The reflector is formed by projected aperture cutting and surface distortion of the aperture in accordance with the method of analysis and synthesis. In addition to reflecting signals from satellites, it also generates focused waves sharing similar radiation patterns and horizontal gain with incoming waves on the focal plane to be received by the compound LNBF modules.

13 Claims, 5 Drawing Sheets

MULTI-BEAM-REFLECTOR DISH ANTENNA SYSTEM AND METHOD FOR PRODUCTION THEREOF

BACKGROUND OF THE INVENTION

1. Field of the Invention

The present invention relates to a multi-beam-reflector dish antenna system and a method for production thereof, and more particularly, a multi-beam-reflector dish antenna system with a reflector formed by N-th order projected aperture cutting and surface distortion of the aperture in accordance with the method of analysis and synthesis and a method for production thereof.

2. Description of the Prior Art

Satellite communication is gaining importance in this world of real-time digital distribution of audio and video data around the globe. It is known that for the purpose of increasing the data capacity of a satellite system, for example a direct broadcast system (DBS). And the reflector dish antenna system is a popular antenna system applied to satellite communication.

Traditionally, the circular parabolic dish antenna commonly used embodies an equation $x^2+y^2=4$ fz, in which f refers to a focal length of the parabolic dish. A low noise block with integrated feed (LNBF) module is installed on a focal point of the parabolic reflector of the dish antenna for reception and down conversion of the satellite signals. The LNBF module on the focal point receives the satellite signals with extremely high carrier-to-noise ratio (C/N) to raise gain and lower spillover loss and improve quality of received signals. On the other hand, the concentrated character of the focal point on the parabolic dish is strong enough to suppresses signals from unnecessary satellites and generate a considerably lower signal paralleled with the parabolic dish. Furthermore, only by planting more dish antennas to receive other satellite signals for the parabolic dish can get the good performances of all of the satellite signals that we want.

Accordingly, another method provides a dish antenna with several independent LNBF modules for receiving multiple different satellite signals at the same time. The dish antenna with a single compound LNBF module uses less space and costs less, compared to the previous technique. It is also more convenient and practical for users. However, there is a need to design a corresponding multi-beam-reflector dish antenna for matching the single compound LNBF module to receive multiple different satellite signals at the same time.

SUMMARY OF THE INVENTION

It is therefore a primary objective of the claimed invention to provide a multi-beam-reflector dish antenna system with a reflector formed by N-th order projected aperture cutting and surface distortion of the aperture in accordance with the method of analysis and synthesis and a method for production thereof for solving the above-mentioned problem.

According to the claimed invention, a multi-beam-reflector dish antenna system includes a reflector for simultaneously receiving signals from a plurality of satellites, and a first low noise block with integrated feed (LNBF) module for receiving radiation waveforms generated by the reflector. The reflector is formed according to the following steps of providing the reflector having N-th order curve surface where the value of factor N equals to 2 returned by $F(x)^N+F(y)^N=F(z)$; executing expansion according to the equation to achieve expansion of $$z(t,\theta)=\sum_{0}^{n}\sum_{0}^{m}[C_{nm}\cos n\theta+D_{nm}\sin n\theta]F_m^n(t),$$

in which expansion coefficients of $C_{nm}$ and $D_{nm}$ are variables; analyzing the radiation waveforms of the reflector according to the expansion coefficients of $C_{nm}$ and $D_{nm}$; synthesizing the radiation waveforms of the reflector to generate a corresponding radiation pattern; and acquiring the multi-beam-reflector dish antenna according to the expansion coefficients, $C_{nm}$ and $D_{nm}$, and the radiation pattern. The values of the expansion coefficients $C_{nm}$ and $D_{nm}$ are substantially:

| n | m | $C_{nm}$ | $D_{nm}$ |
|---|---|---|---|
| 0 | 0 | −10.120820 | 0.000000E+00 |
| 0 | 1 | −7.044662E−01 | 0.000000E+00 |
| 0 | 2 | 4.054082E−03 | 0.000000E+00 |
| 0 | 3 | −7.962435E−04 | 0.000000E+00 |
| 1 | 0 | 0.000000E+00 | 1.884815 |
| 1 | 1 | 0.000000E+00 | −6.625697E−03 |
| 1 | 2 | 0.000000E+00 | 1.293241E−03 |
| 2 | 0 | 4.837928E−01 | 0.000000E+00 |
| 2 | 1 | −9.740479E−04 | 0.000000E+00 |
| 2 | 2 | −5.823930E−04 | 0.000000E+00 |
| 3 | 0 | 0.000000E+00 | 7.859746E−03 |
| 3 | 1 | 0.000000E+00 | −9.120623E−04 |
| 4 | 0 | −8.800388E−04 | 0.000000E+00 |
| 4 | 1 | −1.013141E−03 | 0.000000E+00 |
| 5 | 0 | 0.000000E+00 | −4.191973E−07 |
| 6 | 0 | −1.080019E−06 | 0.000000E+00 |

The values of $C_{nm}$ and $D_{nm}$ are zero or close to zero when corresponding variables n and m are not listed.

According to the claimed invention, a method for producing a multi-beam-reflector dish antenna system is disclosed. The method includes: providing the multi-beam-reflector dish antenna system with a reflector having N-th order curve surface where the value of factor N equals to 2 returned by $F(x)^N+F(y)^N=F(z)$; executing expansion according to the equation to achieve the expansion $$z(t,\theta)=\sum_{0}^{n}\sum_{0}^{m}[C_{nm}\cos n\theta+D_{nm}\sin n\theta]F_m^n(t),$$

in which expansion coefficients of $C_{nm}$ and $D_{nm}$ are variables; analyzing radiation waveforms of the reflector according to the expansion coefficients of $C_{nm}$ and $D_{nm}$, the radiation waveforms being received by a first LNBF module; synthesizing the radiation waveforms of the reflector to generate a corresponding radiation pattern; and drawing and acquiring the multi-beam-reflector dish antenna system according to the expansion coefficients, $C_{nm}$ and $D_{nm}$, and the radiation pattern. The values of the expansion coefficients $C_{nm}$ and $D_{nm}$ are substantially:

| n | m | $C_{nm}$ | $D_{nm}$ |
|---|---|---|---|
| 0 | 0 | −10.120820 | 0.000000E+00 |
| 0 | 1 | −7.044662E−01 | 0.000000E+00 |
| 0 | 2 | 4.054082E−03 | 0.000000E+00 |

-continued

| n | m | $C_{nm}$ | $D_{nm}$ |
|---|---|---|---|
| 0 | 3 | −7.962435E−04 | 0.000000E+00 |
| 1 | 0 | 0.000000E+00 | 1.884815 |
| 1 | 1 | 0.000000E+00 | −6.625697E−03 |
| 1 | 2 | 0.000000E+00 | 1.293241E−03 |
| 2 | 0 | 4.837928E−01 | 0.000000E+00 |
| 2 | 1 | −9.740479E−04 | 0.000000E+00 |
| 2 | 2 | −5.823930E−04 | 0.000000E+00 |
| 3 | 0 | 0.000000E+00 | 7.859746E−03 |
| 3 | 1 | 0.000000E+00 | −9.120623E−04 |
| 4 | 0 | −8.800388E−04 | 0.000000E+00 |
| 4 | 1 | −1.013141E−03 | 0.000000E+00 |
| 5 | 0 | 0.000000E+00 | −4.191973E−07 |
| 6 | 0 | −1.080019E−06 | 0.000000E+00 |

The values of $C_{nm}$ and $D_{nm}$ are zero or close to zero when corresponding variables n and m are not listed.

According to the claimed invention, a multi-beam-reflector dish antenna system includes a reflector for simultaneously receiving signals from a plurality of satellites, and a first low noise block with integrated feed (LNBF) module for receiving radiation waveforms generated by the reflector. The reflector has N-th order curve surface in accordance of expansion of $$z(t, \theta) = \sum_{0}^{n} \sum_{0}^{m} [C_{nm}\cos n\theta + D_{nm}\sin n\theta] F_m^n(t),$$

in which expansion coefficients of $C_{nm}$ and $D_{nm}$ are substantially:

| n | m | $C_{nm}$ | $D_{nm}$ |
|---|---|---|---|
| 0 | 0 | −10.120820 | 0.000000E+00 |
| 0 | 1 | −7.044662E−01 | 0.000000E+00 |
| 0 | 2 | 4.054082E−03 | 0.000000E+00 |
| 0 | 3 | −7.962435E−04 | 0.000000E+00 |
| 1 | 0 | 0.000000E+00 | 1.884815 |
| 1 | 1 | 0.000000E+00 | −6.625697E−03 |
| 1 | 2 | 0.000000E+00 | 1.293241E−03 |
| 2 | 0 | 4.837928E−01 | 0.000000E+00 |
| 2 | 1 | −9.740479E−04 | 0.000000E+00 |
| 2 | 2 | −5.823930E−04 | 0.000000E+00 |
| 3 | 0 | 0.000000E+00 | 7.859746E−03 |
| 3 | 1 | 0.000000E+00 | −9.120623E−04 |
| 4 | 0 | −8.800388E−04 | 0.000000E+00 |
| 4 | 1 | −1.013141E−03 | 0.000000E+00 |
| 5 | 0 | 0.000000E+00 | −4.191973E−07 |
| 6 | 0 | −1.080019E−06 | 0.000000E+00 |

The values of $C_{nm}$ and $D_{nm}$ are zero or close to zero when corresponding variables n and m are not listed.

The present invention utilizes a theory of physical optics which is referenced to research as follows.

Research Disclosure Vol. 43, NO. 1, "A Generalized Diffraction Synthesis Technique for High Performance Reflector Antenna", IEEE Trans. On Antennas and Propagation, Dah-Ewih Duan and Yahmat-Samii, January 1995, discloses a steepest decent method (SDM) which is a widely employed procedure for the synthesis of shaped reflectors in contoured beam applications. The SDM is efficient in computational convergence, but highly depends on an initial starting point and could very easily reach a local optimum.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
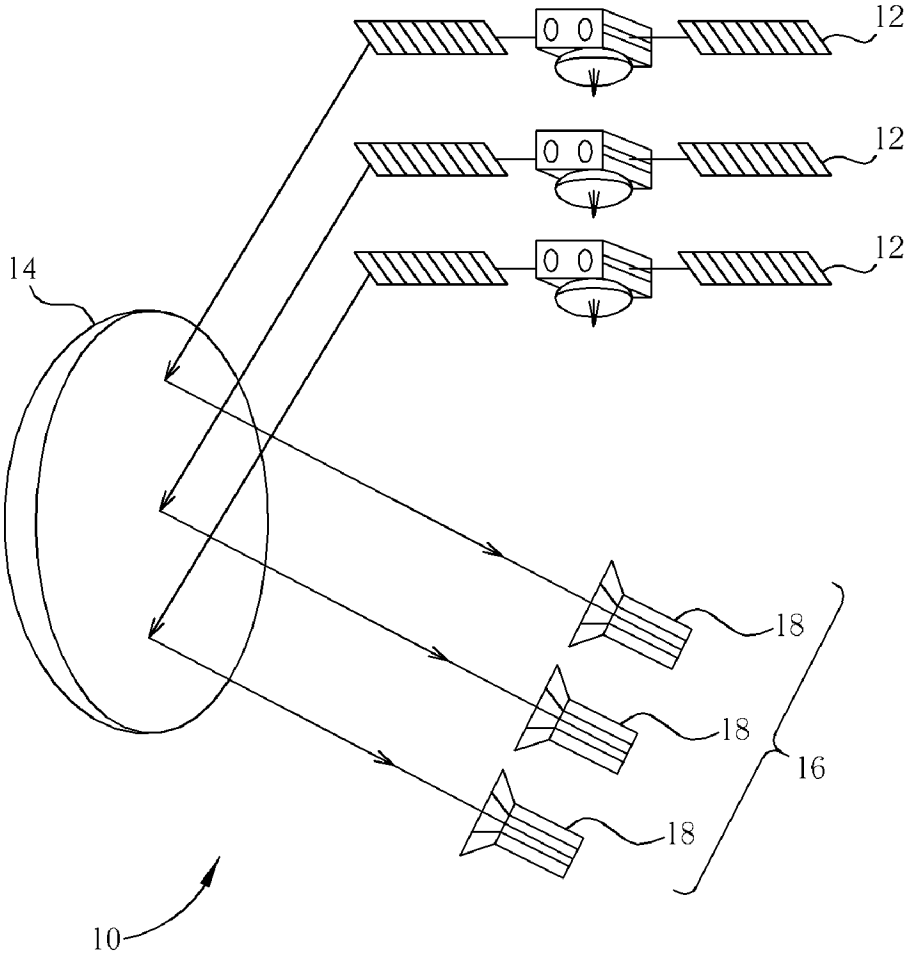
FIG. 1 is an overview diagram of a multi-beam-reflector dish antenna system receiving signals from a plurality of satellites according to an embodiment of the present invention.

Please refer to FIG. 1 which is an overview diagram of a multi-beam-reflector dish antenna system 10 receiving signals from a plurality of satellites 12 according to an embodiment of the present invention. The multi-beam-reflector dish antenna system 10 includes a reflector 14 with a super ellipse projected aperture for simultaneously receiving the signals from the plurality of satellites 12 and having the signals concentrated on the focal point or plane. The multi-beam-reflector dish antenna system 10 further includes at least a first low noise block with integrated feed (LNBF) module 16 which can be a single compound LNBF module. The first LNBF module 16 includes a plurality of second LNBF modules 18 positioned on the focal plane of the reflector 14. The reflector 14 reflects the signals emitted from the plurality of satellites 12 and generates focused waves respectively on the focal plane to be received by the second LNBF modules 18 of the first LNBF module 16. The first LNBF module 16 is capable of converting incoming radio frequency signals into intermediate frequency signals and send said signals to a tuner. As a result of the strong concentrating character of the focal point or plane on the reflector 14, the first LNBF module 16 on the focal point or plane receives signals with extremely high S/N (signal to noise) ratio. This significantly enhances reception. In other words, the strong concentrating character of the focal point or plane on the reflector 14 contributes to gain raise, lower spillover loss and a better quality of received signal.

Figure 2:
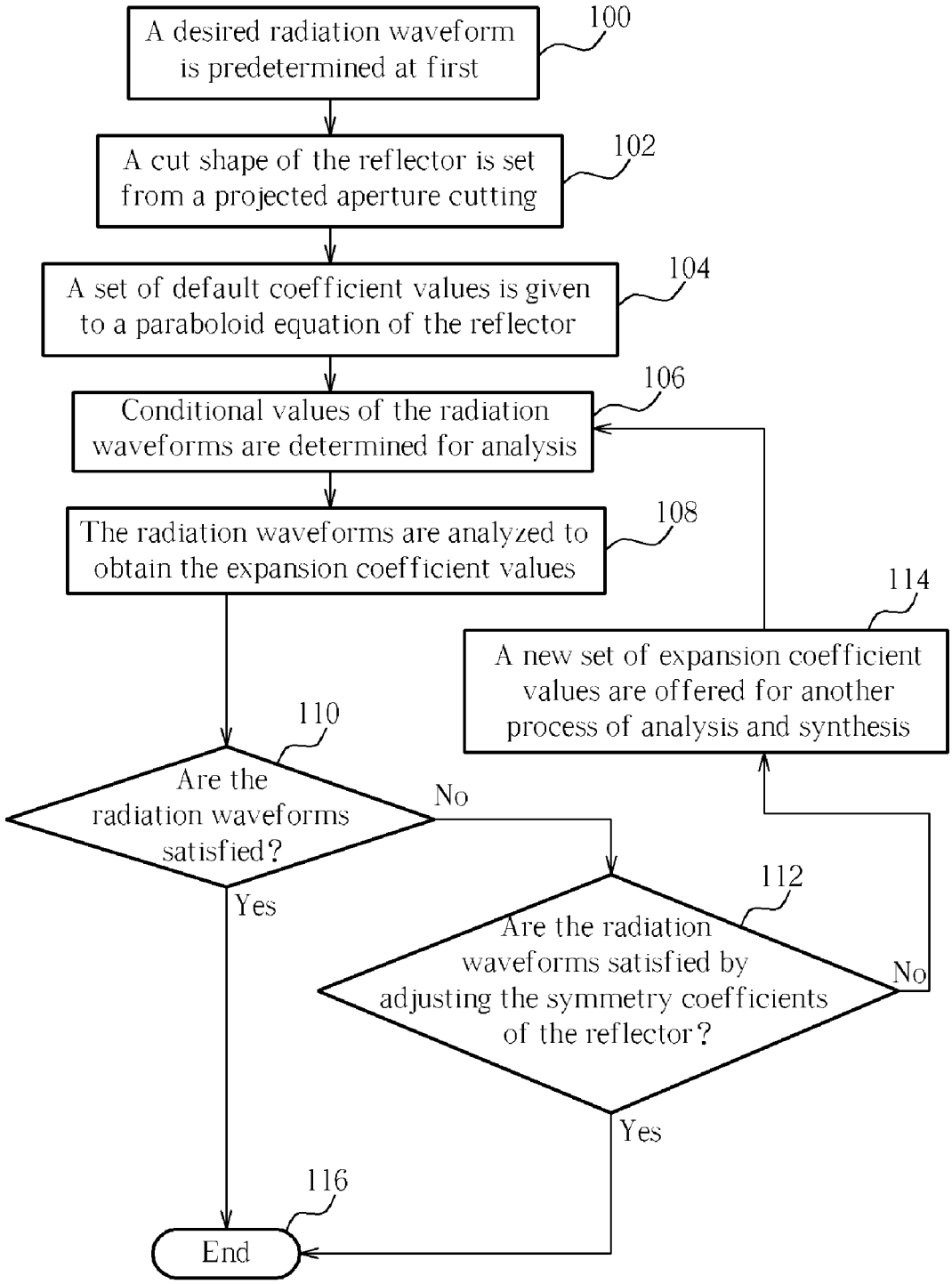
FIG. 2 is a flowchart of synthesis of a reflector according to the embodiment of the present invention.
Figure 3:
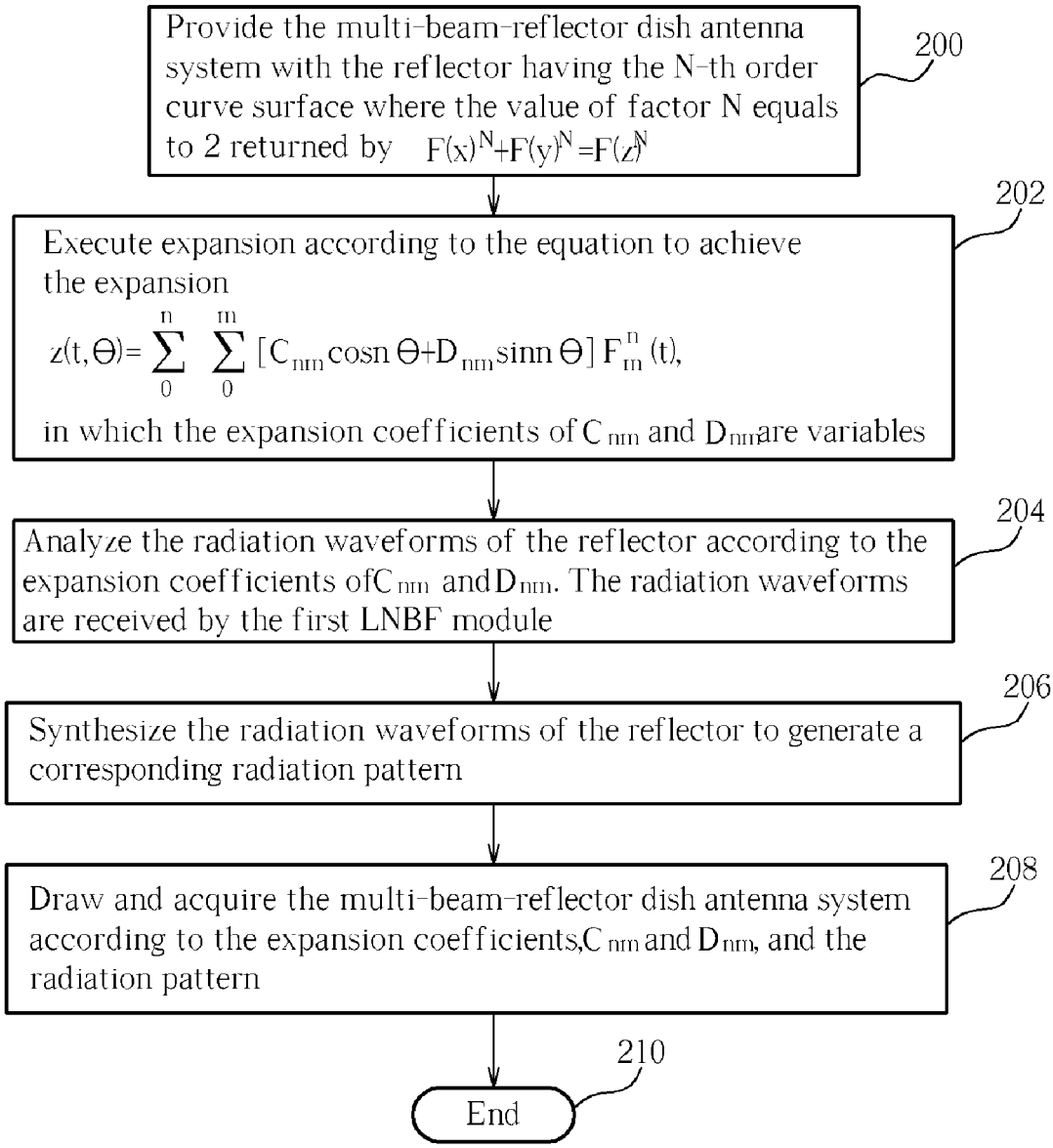
FIG. 3 is a flowchart of producing the multi-beam-reflector dish antenna system according to the embodiment of the present invention.
Figure 4:
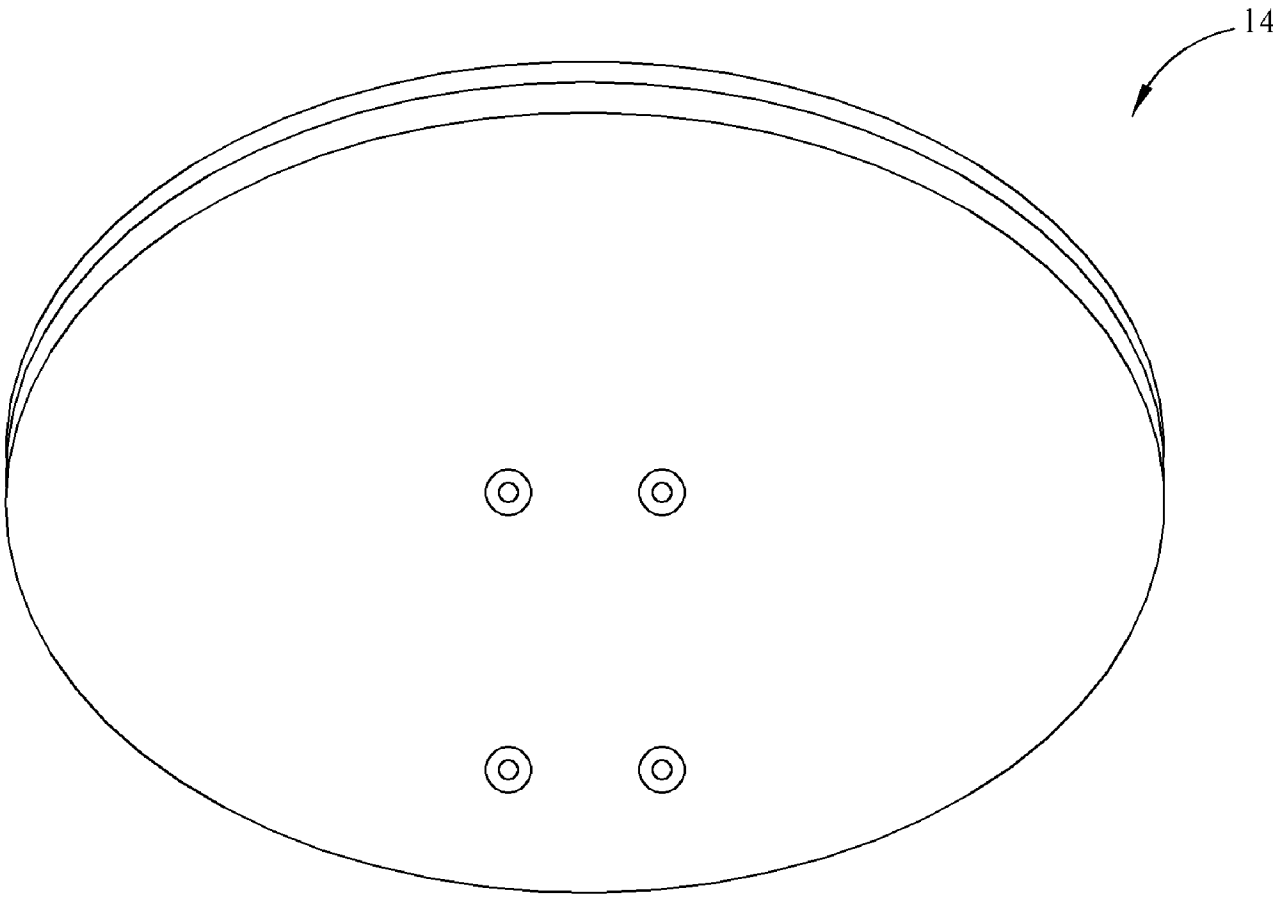
FIG. 4 is a schematic diagram showing the shape of the reflector according to the embodiment of the present invention.
Figure 5:
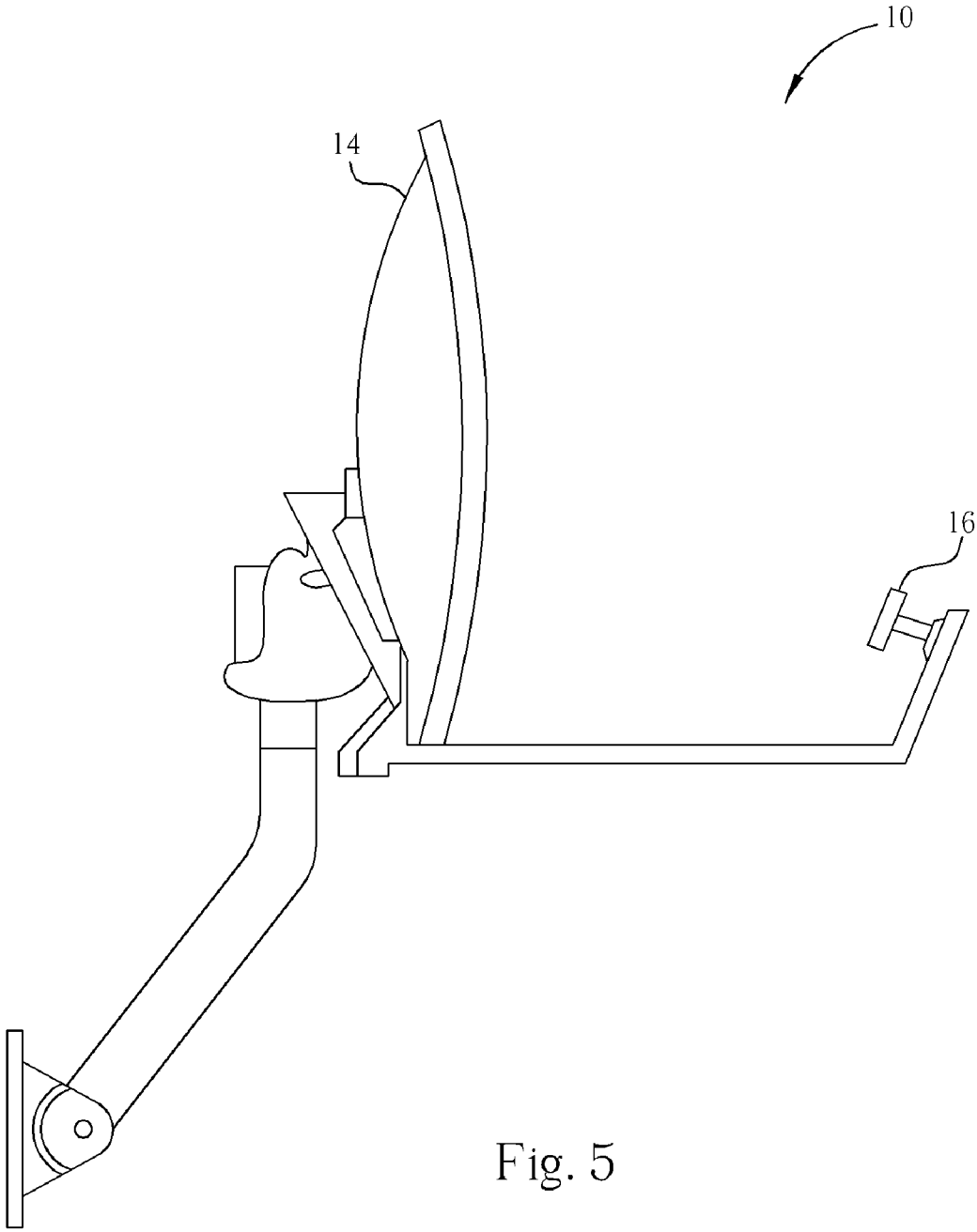
FIG. 5 is a schematic diagram showing the profile of the multi-beam-reflector dish antenna according to the embodiment of the present invention.

Please refer to FIG. 2 to FIG. 5. FIG. 2 is a flowchart of synthesis of the reflector 14 according to the embodiment of the present invention. FIG. 3 is a flowchart of producing the multi-beam-reflector dish antenna system 10 according to the embodiment of the present invention. FIG. 4 is a schematic diagram showing the shape of the reflector 14 according to the embodiment of the present invention. FIG. 5 is a schematic diagram showing the profile of the multi-beam-reflector dish antenna 10 according to the embodiment of the present invention. The synthesis of the reflector 14 includes the following steps:

Step 100: A desired radiation waveform is predetermined at first.

Step 102: A cut shape of the reflector 14 is set from a projected aperture cutting.

Step 104: A set of default coefficient values is given to a paraboloid equation of the reflector 14. A set of default input expansion coefficient values is acquired in accordance with projected aperture cutting by the paraboloid equation.

Step 106: Conditional values of the radiation waveforms are determined for analysis.

Step 108: The radiation waveforms are analyzed to obtain the expansion coefficient values.

Step 110: The radiation waveforms are verified to ensure that the radiation waveforms are satisfied. If the radiation waveforms are satisfied, go to step 116; and if the radiation waveforms are not satisfied, go to step 112.

Step 112: The radiation waveforms are re-verified to further ensure that the radiation waveforms are satisfied by adjusting the symmetry coefficients of the reflector 14. If the re-verified radiation waveforms satisfy the default setting, go to step 116; and if the re-verified radiation waveforms do not satisfy the default setting, go to step 114.

Step 114: A new set of expansion coefficient values are offered for another process of analysis and synthesis.

Step 116: End.

The method for producing the multi-beam-reflector dish antenna system 10 includes the following steps:

Step 200: Provide the multi-beam-reflector dish antenna system 10 with the reflector 14 having the N-th order curve surface where the value of factor N equals to 2 returned by $F(x)^N+F(y)^N=F(z)$.

Step 202: Execute expansion according to the equation to achieve the expansion $$z(t,\theta)=\sum_{0}^{n}\sum_{0}^{m}[C_{nm}\cos n\theta+D_{nm}\sin n\theta]F_m^n(t),$$

in which the expansion coefficients of $C_{nm}$ and $D_{nm}$ are variables.

Step 204: Analyze the radiation waveforms of the reflector 14 according to the expansion coefficients of $C_{nm}$ and $D_{nm}$. The radiation waveforms are received by the first LNBF module 16.

Step 206: Synthesize the radiation waveforms of the reflector 14 to generate a corresponding radiation pattern.

Step 208: Draw and acquire the multi-beam-reflector dish antenna system 10 according to the expansion coefficients, $C_{nm}$ and $D_{nm}$, and the radiation pattern.

Step 210: End.

More detailed descriptions for the steps mentioned above will be provided. The reflector 14 has the N-th order curve surface where the value of factor N equals to 2 returned by $F(x)^N+F(y)^N=F(z)$. That is, the reflector 14 is formed through surface distortion, and the shape of the reflector 14 is gained from projection of a super ellipse. The super ellipse is returned by $$\left[\frac{x}{A}\right]^N+\left[\frac{y}{B}\right]^N=1,$$

where z=f (a focal length of the reflector 14), N is equal to 2, A is the horizontal axial length of the N-th order projected aperture and B is the vertical axial length. For getting the shape of the reflector 14 of the present invention, we can discuss from two parts: numerical analysis and synthesis. The importance of analysis is to retrieve radiation pattern produced by the reflector 14 having given feed horn elements (including radiation waveforms and weights) of the multi-beam-reflector dish antenna system 10. It should be noted that the feed horn element, as radiation waveforms, generally is hypothetical or given on account of the element could be simulated by $\cos^q\theta$, and therefore the variation of the radiation waveforms are not involved in the method of analysis.

The present invention utilizes a theory of physical optics which is referenced to research as follows.

Research Disclosure Vol. 43, NO. 1, "A Generalized Diffraction Synthesis Technique for High Performance Reflector Antenna", IEEE Trans. On Antennas and Propagation, Dah-Ewih Duan and Yahmat-Samii, January 1995, discloses a steepest decent method (SDM) which is a widely employed procedure for the synthesis of shaped reflectors in contoured beam applications. The SDM is efficient in computational convergence, but highly depends on an initial starting point and could very easily reach a local optimum.

Based on theories of physical optics (PO), the cut square measure is performed by a basis expansion, that is to say, as shown in page 30, Research Disclosure Vol. 43, NO. 1, "A Generalized Diffraction Synthesis Technique for High Performance Reflector Antenna", IEEE Trans. On Antennas and Propagation, Dah-Ewih Duan and Yahmat-Samii, January 1995, performing the basis expansion on the equation above and returning $$z(t,\theta)=\sum_{0}^{n}\sum_{0}^{m}[C_{nm}\cos n\theta+D_{nm}\sin n\theta]F_m^n(t)$$

The shaped reflector surfaces are described by the expansion z(t,θ), and expansion coefficients of $C_{nm}$ and $D_{nm}$ can be obtained by the basis expansion of the N-th order projected aperture and following integrations. $F_m^n(t)$ is the modified Jacobi polynomials related to the circle polynomials of Zernike. Moreover, the coefficients can be used to conduct corresponding radiation patterns, peak angles, gains, sidelobe and others, verified to meet standard conditional values. Main lobes and first sidelobes of the radiation waveforms are critical applications to the dish antenna system. The theory of physical optics performs well with the lobes and is referenced to research as mentioned above.

The object of synthesis is to modify weights and shape of the reflector 14 to meet a desired standard of waveform generated by the reflector 14. Generally, iteration is used to adjust weights of the feed horn elements or the shape of the reflector 14 in accordance with predetermined conditions of radiation waveforms until the radiation waveforms meet desired conditions. Briefly, the equation above is given default related data (default value of $C_{nm}$ and $D_{nm}$ of the reflector 14, radiation waveforms of feed horn, coordinates, phase and weights of the relative reflector 14) of the reflector 14 and desired radiation pattern of the reflector 14 (the lowest and the highest gains of desired angle) in the beginning and thereby starts the synthesis method to get a result fitting the default condition. The radiation pattern is analyzed and measured in accordance with the acquired coefficients to modify the required condition of the radiation pattern. The synthesis method is repeated until the expansion coefficients, $C_{nm}$ and $D_{nm}$, match the radiation pattern. The expansion coefficients are expanded as coordinates of the reflector 14 of the multi-beam-reflector dish antenna system 10 for drawing, manufacturing and testing a sample.

The reflector 14 according to the preferred embodiment of the present invention is described in detail below. The actual size of the reflector 14 is substantially 23 inches long and 33 inches wide. The projection plate of the reflector 14 is substantially 21.08 inches long and 32 inches wide. The focal length of the reflector 14 is substantially 17.6 inches. The tolerance of each point of the reflector 14 is substantially between 0.028 inches and −0.028 inches. The reflector 14 has the N-th order curve surface in accordance of expansion of $$z(t,\theta)=\sum_{0}^{n}\sum_{0}^{m}[C_{nm}\cos n\theta+D_{nm}\sin n\theta]F_m^n(t).$$

The expansion coefficients of $C_{nm}$ and $D_{nm}$ are substantially as follows,

| n | m | $C_{nm}$ | $D_{nm}$ |
|---|---|---|---|
| 0 | 0 | −10.120820 | 0.000000E+00 |
| 0 | 1 | −7.044662E−01 | 0.000000E+00 |
| 0 | 2 | 4.054082E−03 | 0.000000E+00 |
| 0 | 3 | −7.962435E−04 | 0.000000E+00 |
| 1 | 0 | 0.000000E+00 | 1.884815 |
| 1 | 1 | 0.000000E+00 | −6.625697E−03 |
| 1 | 2 | 0.000000E+00 | 1.293241E−03 |
| 2 | 0 | 4.837928E−01 | 0.000000E+00 |
| 2 | 1 | −9.740479E−04 | 0.000000E+00 |
| 2 | 2 | −5.823930E−04 | 0.000000E+00 |
| 3 | 0 | 0.000000E+00 | 7.859746E−03 |
| 3 | 1 | 0.000000E+00 | −9.120623E−04 |
| 4 | 0 | −8.800388E−04 | 0.000000E+00 |
| 4 | 1 | −1.013141E−03 | 0.000000E+00 |
| 5 | 0 | 0.000000E+00 | −4.191973E−07 |
| 6 | 0 | −1.080019E−06 | 0.000000E+00 |

The values of $C_{nm}$ and $D_{nm}$ are zero or close to zero when corresponding variables n and m are not listed. For example, the values of $C_{nm}$ and $D_{nm}$ are equal to zero or between $10^{-10}$ and $10^{-6}$ when the corresponding variables n and m are not listed.

In contrast to conventional dish antenna technique, the multi-beam-reflector dish antenna system of the present invention has the following advantages. The reflector of the dish antenna uses the method of numerical analysis and synthesis to deploy surface distortion on a single reflector according to requirements of a multi-beam-reflector dish antenna, and analyzes the synthesized reflector to provide the best possible results according to the generated effect of the dish antenna. The multi-beam-reflector dish antenna is produced by synthesizing and deforming the single reflector to perform better at wide angles than the conventional techniques (higher gains and better first sidelobe). The smaller reflector of dish antenna of the present invention is produced by numerical analysis and synthesis, at a lower cost and with better effect. In addition, it is important to utilize surface distortion or phase array feed horn of a single reflector of dish antenna to generate multiple beams, newly applied to the antenna. Not only can the single reflector of dish antenna send signals with bi-directional communication to multiple satellites to save costs while efficiently simultaneously tracking the satellites with each other. Furthermore, it also can be used at point-to-point microwave delivery.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A multi-beam-reflector dish antenna system comprising:

a reflector for simultaneously receiving signals from a plurality of satellites; and a first low noise block with integrated feed (LNBF) module for receiving radiation waveforms generated by the reflector, in which the reflector is formed according to the following steps of:

providing the reflector having N-th order curve surface where the value of factor N equals to 2 returned by $F(x)^N+F(y)^N=F(z)$;

executing expansion according to the equation to achieve expansion of $$z(t,\theta)=\sum_{0}^{n}\sum_{0}^{m}[C_{nm}\cos n\theta+D_{nm}\sin n\theta]F_m^n(t),$$

in which expansion coefficients of $C_{nm}$ and $D_{nm}$ are variables;

analyzing the radiation waveforms of the reflector according to the expansion coefficients of $C_{nm}$ and $D_{nm}$;

synthesizing the radiation waveforms of the reflector to generate a corresponding radiation pattern; and acquiring the multi-beam-reflector dish antenna according to the expansion coefficients, $C_{nm}$ and $D_{nm}$, and the radiation pattern;

wherein the values of the expansion coefficients $C_{nm}$ and $D_{nm}$ are substantially:

| n | m | $C_{nm}$ | $D_{nm}$ |
|---|---|---|---|
| 0 | 0 | −10.120820 | 0.000000E+00 |
| 0 | 1 | −7.044662E−01 | 0.000000E+00 |
| 0 | 2 | 4.054082E−03 | 0.000000E+00 |
| 0 | 3 | −7.962435E−04 | 0.000000E+00 |
| 1 | 0 | 0.000000E+00 | 1.884815 |
| 1 | 1 | 0.000000E+00 | −6.625697E−03 |
| 1 | 2 | 0.000000E+00 | 1.293241E−03 |
| 2 | 0 | 4.837928E−01 | 0.000000E+00 |
| 2 | 1 | −9.740479E−04 | 0.000000E+00 |
| 2 | 2 | −5.823930E−04 | 0.000000E+00 |
| 3 | 0 | 0.000000E+00 | 7.859746E−03 |
| 3 | 1 | 0.000000E+00 | −9.120623E−04 |
| 4 | 0 | −8.800388E−04 | 0.000000E+00 |
| 4 | 1 | −1.013141E−03 | 0.000000E+00 |
| 5 | 0 | 0.000000E+00 | −4.191973E−07 |
| 6 | 0 | −1.080019E−06 | 0.000000E+00 |

wherein the values of $C_{nm}$ and $D_{nm}$ are zero or between $10^{-10}$ and $10^{-6}$ when corresponding variables n and m are not listed.

2. The multi-beam-reflector dish antenna system of claim 1, wherein the size of the reflector is substantially 23 inches long and 33 inches wide.

3. The multi-beam-reflector dish antenna system of claim 1, wherein a focal length of the reflector is substantially 17.6 inches and tolerance of each point of the reflector is substantially between 0.028 inches and −0.028 inches.

4. The multi-beam-reflector dish antenna system of claim 1, wherein the first LNBF module includes a plurality of second LNBF modules.

5. A method for producing a multi-beam-reflector dish antenna system, the method comprising:

providing the multi-beam-reflector dish antenna system with a reflector having N-th order curve surface where the value of factor N equals to 2 returned by $F(x)^N + F(y)^N = F(z)$;

executing expansion according to the equation to achieve the expansion $$z(t, \theta) = \sum_{0}^{n} \sum_{0}^{m} [C_{nm} \cos n\theta + D_{nm} \sin n\theta] F_m^n(t),$$

in which expansion coefficients of $C_{nm}$ and $D_{nm}$ are variables;

analyzing radiation waveforms of the reflector according to the expansion coefficients of $C_{nm}$ and $D_{nm}$, the radiation waveforms being received by a first LNBF module;

synthesizing the radiation waveforms of the reflector to generate a corresponding radiation pattern; and drawing and acquiring the multi-beam-reflector dish antenna system according to the expansion coefficients, $C_{nm}$ and $D_{nm}$, and the radiation pattern;

wherein the values of the expansion coefficients $C_{nm}$ and $D_{nm}$ are substantially:

| N | m | $C_{nm}$ | $D_{nm}$ |
|---|---|---|---|
| 0 | 0 | −10.120820 | 0.000000E+00 |
| 0 | 1 | −7.044662E−01 | 0.000000E+00 |
| 0 | 2 | 4.054082E−03 | 0.000000E+00 |
| 0 | 3 | −7.962435E−04 | 0.000000E+00 |
| 1 | 0 | 0.000000E+00 | 1.884815 |
| 1 | 1 | 0.000000E+00 | −6.625697E−03 |
| 1 | 2 | 0.000000E+00 | 1.293241E−03 |
| 2 | 0 | 4.837928E−01 | 0.000000E+00 |
| 2 | 1 | −9.740479E−04 | 0.000000E+00 |
| 2 | 2 | −5.823930E−04 | 0.000000E+00 |
| 3 | 0 | 0.000000E+00 | 7.859746E−03 |
| 3 | 1 | 0.000000E+00 | −9.120623E−04 |
| 4 | 0 | −8.800388E−04 | 0.000000E+00 |
| 4 | 1 | −1.013141E−03 | 0.000000E+00 |
| 5 | 0 | 0.000000E+00 | −4.191973E−07 |
| 6 | 0 | −1.080019E−06 | 0.000000E+00 |

wherein the values of $C_{nm}$ and $D_{nm}$ are zero or between $10^{-10}$ and $10^{-6}$ when corresponding variables n and m are not listed.

6. The method of claim 5, wherein the size of the reflector is substantially 23 inches long and 33 inches wide.

7. The method of claim 5, wherein a focal length of the reflector is substantially 17.6 inches and tolerance of each point of the reflector is substantially between 0.028 inches and −0.028 inches.

8. The method of claim 5, wherein the first LNBF module includes a plurality of second LNBF modules.

9. A multi-beam-reflector dish antenna system comprising:

a reflector for simultaneously receiving signals from a plurality of satellites; and a first low noise block with integrated feed (LNBF) module for receiving radiation waveforms generated by the reflector;

wherein the reflector has N-th order curve surface in accordance of expansion of $$z(t, \theta) = \sum_{0}^{n} \sum_{0}^{m} [C_{nm} \cos n\theta + D_{nm} \sin n\theta] F_m^n(t),$$

in which expansion coefficients of $C_{nm}$ and $D_{nm}$ are substantially:

| n | m | $C_{nm}$ | $D_{nm}$ |
|---|---|---|---|
| 0 | 0 | −10.120820 | 0.000000E+00 |
| 0 | 1 | −7.044662E−01 | 0.000000E+00 |
| 0 | 2 | 4.054082E−03 | 0.000000E+00 |
| 0 | 3 | −7.962435E−04 | 0.000000E+00 |
| 1 | 0 | 0.000000E+00 | 1.884815 |
| 1 | 1 | 0.000000E+00 | −6.625697E−03 |
| 1 | 2 | 0.000000E+00 | 1.293241E−03 |
| 2 | 0 | 4.837928E−01 | 0.000000E+00 |
| 2 | 1 | −9.740479E−04 | 0.000000E+00 |
| 2 | 2 | −5.823930E−04 | 0.000000E+00 |
| 3 | 0 | 0.000000E+00 | 7.859746E−03 |
| 3 | 1 | 0.000000E+00 | −9.120623E−04 |
| 4 | 0 | −8.800388E−04 | 0.000000E+00 |
| 4 | 1 | −1.013141E−03 | 0.000000E+00 |
| 5 | 0 | 0.000000E+00 | −4.191973E−07 |
| 6 | 0 | −1.080019E−06 | 0.000000E+00 |

wherein the values of $C_{nm}$ and $D_{nm}$ are zero or between $10^{-10}$ and $10^{-6}$ when corresponding variables n and m are not listed.

10. The multi-beam-reflector dish antenna system of claim 9, wherein the reflector has the N-th order curve surface where the value of factor N equals to 2 returned by $F(x)^N + F(y)^N = F(z)$.

11. The multi-beam-reflector dish antenna system of claim 9, wherein the size of the reflector is substantially 23 inches long and 33 inches wide.

12. The multi-beam-reflector dish antenna system of claim 9, wherein a focal length of the reflector is substantially 17.6 inches and tolerance of each point of the reflector is substantially between 0.028 inches and −0.028 inches.

13. The multi-beam-reflector dish antenna system of claim 9, wherein the first LNBF module includes a plurality of second LNBF modules.

* * * * *